US007918196B2

(12) United States Patent
Ishizaka et al.

(10) Patent No.: US 7,918,196 B2
(45) Date of Patent: Apr. 5, 2011

(54) VERTICAL TYPE ENGINE

(75) Inventors: Kazuhiro Ishizaka, Wako (JP); Atsumu Naoi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 391 days.

(21) Appl. No.: 12/056,832

(22) Filed: Mar. 27, 2008

(65) Prior Publication Data

US 2008/0245321 A1 Oct. 9, 2008

(30) Foreign Application Priority Data

Mar. 30, 2007 (JP) ..... 2007-091754

(51) Int. Cl.
*F01M 13/00* (2006.01)

(52) U.S. Cl. ..... 123/41.86; 123/572; 123/573; 123/574; 440/88 R; 440/88 A

(58) Field of Classification Search ..... 123/41.86, 123/572–574
See application file for complete search history.

(56) References Cited

U.S. PATENT DOCUMENTS 5,383,440 A * 1/1995 Koishikawa et al. ..... 123/572
5,514,015 A * 5/1996 Okazawa et al. ..... 440/88 L
6,516,768 B1 * 2/2003 Watanabe ..... 123/184.36

FOREIGN PATENT DOCUMENTS

JP 9-41937 A 2/1997
JP 10089040 A * 4/1998

* cited by examiner

*Primary Examiner* — Michael Cuff
*Assistant Examiner* — Hung Q Nguyen
(74) *Attorney, Agent, or Firm* — Arent Fox LLP

(57) ABSTRACT

A vertical type engine includes: an engine body having a crank chamber and a cylinder bore; and a timing transmission chamber provided above the engine body and housing a timing transmission device that connects between a crankshaft and a cam shaft which are vertically placed, respectively, wherein a generator driven by the crankshaft is placed above the timing transmission device, and a breather chamber communicating with the crank chamber and an intake silencer box is provided between the generator and the crank chamber placed below the generator on the side opposite from the cam shaft with respect to the crankshaft. Hence, a vertical type engine that includes a breather chamber dedicated for gas-liquid separation and is compact can be achieved.

6 Claims, 11 Drawing Sheets

VERTICAL TYPE ENGINE

CROSS-REFERENCE TO RELATED APPLICATION

This application claims the priority of JP Application No. 2007-91754, filed Mar. 30, 2007, the entire specification, claims and drawings of which are incorporated herewith by reference.

BACKGROUND OF THE INVENTION

1. Field of the Invention

The present invention relates to a vertical type engine comprising: an engine body having a crank chamber and a cylinder bore; and a timing transmission chamber provided above the engine body and housing a timing transmission device that connects between a crankshaft and a cam shaft which are vertically placed, respectively. Especially the present invention relates to a vertical type engine including a breather chamber that makes gas-liquid separation of blow-by gas while allowing an exhaust of blow-by gas from a crank chamber.

2. Description of the Related Art

A vertical type engine has been known in which a timing transmission chamber communicating with a crank chamber is provided above an engine body, a breather pipe communicating with the outside is connected to an upper wall of the timing transmission chamber, and the timing transmission chamber also serves as a breather chamber as disclosed in Japanese Patent Application Laid-open No. 9-41937.

In a timing transmission chamber, an operation of a timing transmission device causes dispersion of lubricant oil though an amount of dispersed lubricant oil is smaller than that in a crank chamber, which makes effective gas-liquid separation difficult. Thus, if a breather pipe is directly connected to the timing transmission chamber, a considerable amount of oil droplets may be discharged to the breather pipe together with a blow-by gas.

SUMMARY OF THE INVENTION

The present invention is achieved in view of this point, and has an object to provide a vertical type engine that includes a breather chamber dedicated for gas-liquid separation and is compact.

In order to achieve the above-mentioned object, according to a first feature of the present invention, there is provided that a vertical type engine comprising: an engine body having a crank chamber and a cylinder bore; and a timing transmission chamber provided above the engine body and housing a timing transmission device that connects between a crankshaft and a cam shaft which are vertically placed, respectively, wherein a generator driven by the crankshaft is placed above the timing transmission device, and a breather chamber communicating with the crank chamber and an outside is provided between the generator and the crank chamber placed below the generator on the side opposite from the cam shaft with respect to the crankshaft.

With the first feature, the breather chamber dedicated for gas-liquid separation is provided between the generator and the crank chamber placed below the generator on the side opposite from the timing transmission device, thereby allowing oil to be efficiently separated from breathing gas in the crank chamber, and preventing the breather chamber from increasing the entire size of the engine.

According to a second feature of the present invention, in addition to the first feature, the timing transmission chamber and the breather chamber are defined between the engine body and a cover member joined to the engine body so as to cover an upper surface of the engine body, and a bulkhead between the timing transmission chamber and the breather chamber is integrally formed with one or both of the engine body and the cover member.

With the second feature, by simply joining the cover member to the upper surface of the engine body, the timing transmission chamber and the breather chamber can be easily formed between the cover member and the engine body, thereby simplifying a structure and increasing assembling properties.

According to a third feature of the present invention, in addition to the second feature, a rotor of the generator is mounted to an outer end of the crankshaft passing through a through hole provided in the cover member, and a stator of the generator is mounted to the cover member.

With the third feature, the cover member has a broad upper surface wall extending from the timing transmission chamber to the breather chamber, and the stator that cooperates with the rotor secured to the crankshaft can be easily mounted using the upper surface wall.

According to a fourth feature of the present invention, in addition to any of the first to third features, communication is provided between the breather chamber and the crank chamber via a breather inlet pipe protruding downward from an upper inner surface of the crank chamber.

With the fourth feature, droplets of oil dispersed in the crank chamber are prevented as much as possible from flowing into the breather inlet pipe.

According to a fifth feature of the present invention, in addition to any of the first to third features, communication is provided between the crank chamber and the breather chamber via the timing transmission chamber.

With the fifth feature, the breathing gas in the crank chamber is exhausted via the timing transmission chamber to the breather chamber, thus the timing transmission chamber functions as a pre-breather chamber and cooperates with the dedicated breather chamber, thereby allowing oil to be more efficiently separated from the breathing gas in the crank chamber.

According to a sixth feature of the present invention, in addition to any of the first to third features, the breather chamber is comprised of an upper breather chamber and a lower breather chamber which are vertically arranged one on another with a partition plate therebetween, the partition plate has a communication hole that provides communication between the upper breather chamber and the lower breather chamber, and one of the upper breather chamber and the lower breather chamber communicates with the crank chamber and the other communicates with the outside.

With the sixth feature, the breathing gas in the crank chamber is decompressed in two steps by the lower breather chamber and the upper breather chamber, thereby allowing oil from being more efficiently separated from the breathing gas in the crank chamber.

The above-mentioned object, other objects, characteristics, and advantages of the present invention will become apparent from an explanation of preferred embodiments, which will be described in detail below with reference to the attached drawings.

DESCRIPTION OF THE PREFERRED EMBODIMENT

Now, preferred embodiments of the present invention will be described with reference to the drawings.

In the following description, the terms "front", "rear", "right" and "left" are used with. reference to a boat B to which the outboard engine system O is mounted.

Figure 1:
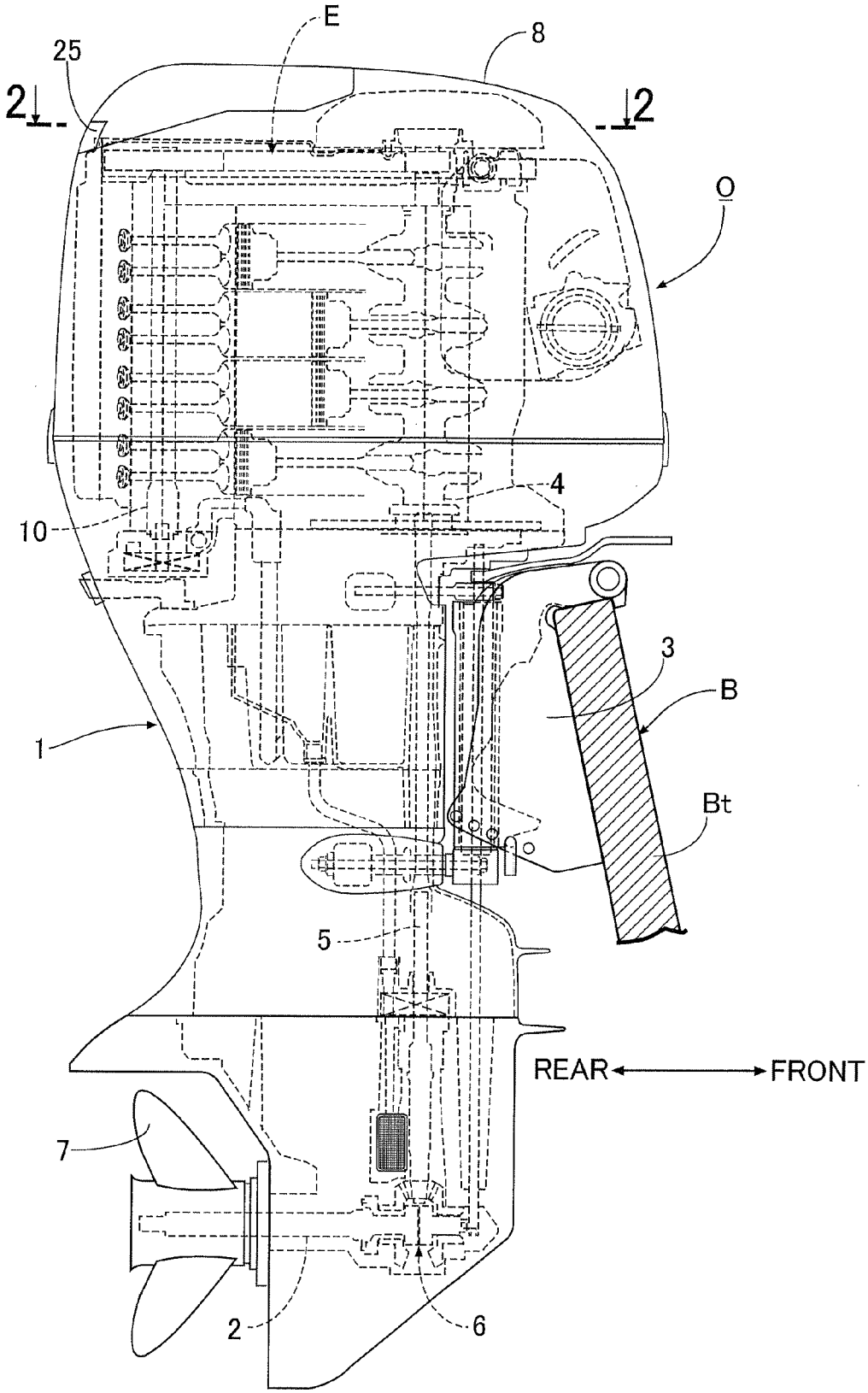
FIG. 1 is a side view of an outboard engine system including an engine according to the first embodiment of the present invention.

First, an explanation of the first embodiment of the present invention will be described. In FIG. 1, the outboard engine system O includes a vertically long casing 1, a vertical type multi-cylinder engine E mounted on an upper end of the casing 1, a propeller shaft 2 supported by a lower end portion of the casing 1, and a stern bracket 3 provided in a front portion of the casing 1 and which is removably mounted to a transom Bt of the boat B. In the casing 1, a drive shaft 5 connected to a crankshaft 4 of the engine E, and a forward/rearward movement switching mechanism 6 connecting a lower end portion of the drive shaft 5 to the propeller shaft 2 are provided, and a propeller 7 is mounted to a rear end of the propeller shaft 2. To the upper end of the casing 1, an engine cover 8 that covers the engine E is removably mounted.

Figure 2:
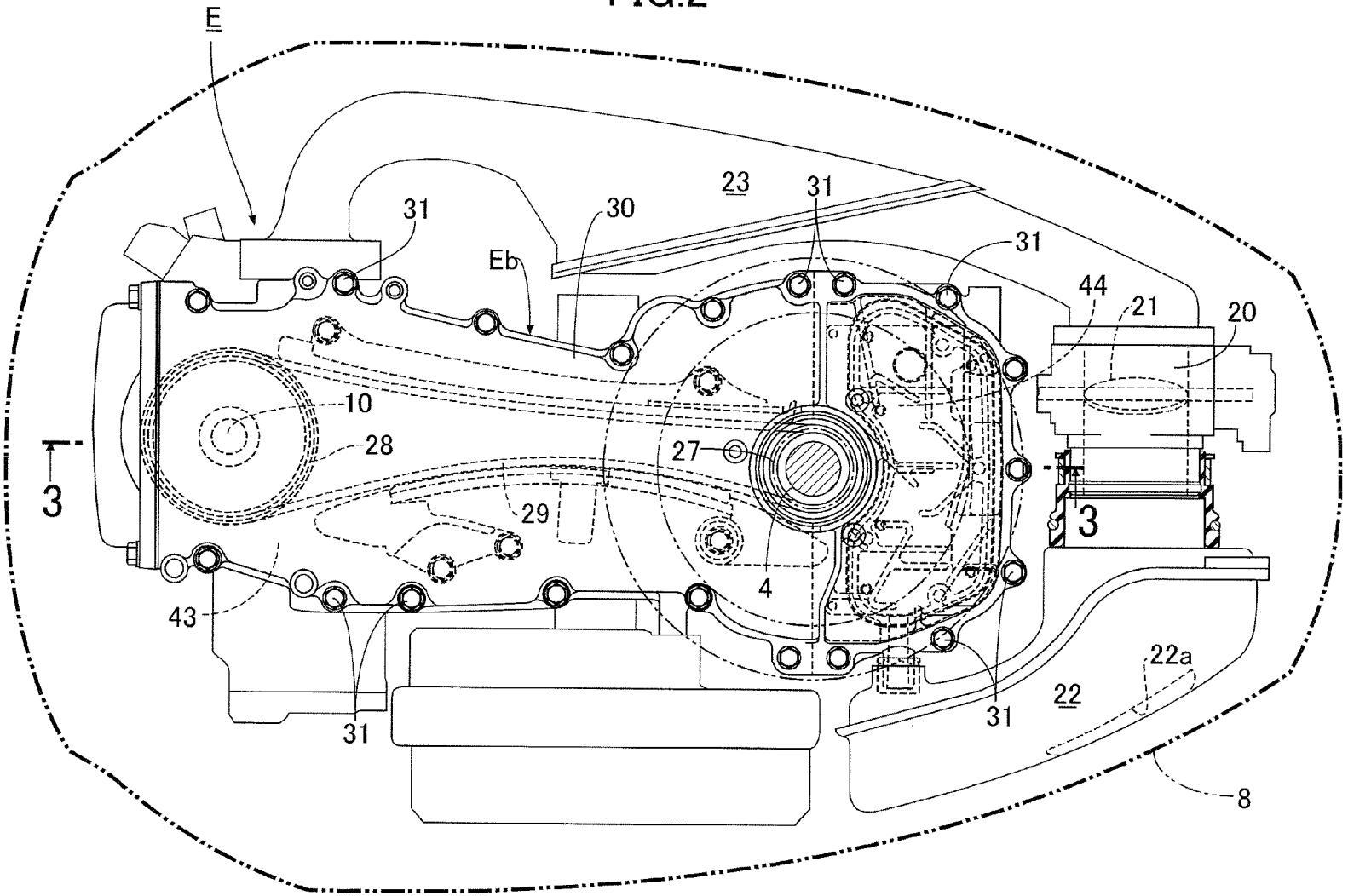
FIG. 2 is a view taken along the arrow direction of the line 2-2 in FIG. 1.
Figure 3:
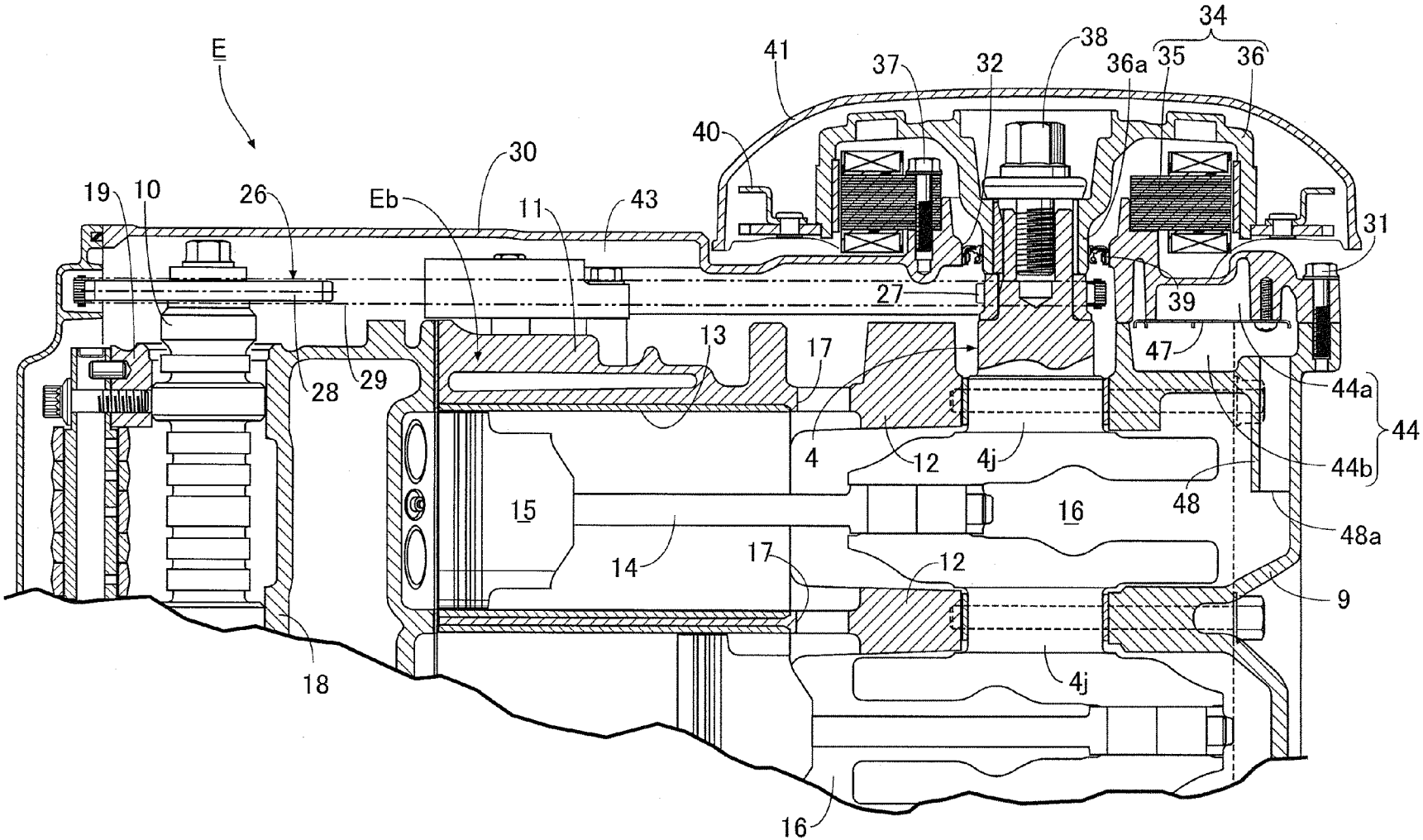
FIG. 3 is a sectional view taken along the line 3-3 in FIG. 2.
Figure 4:
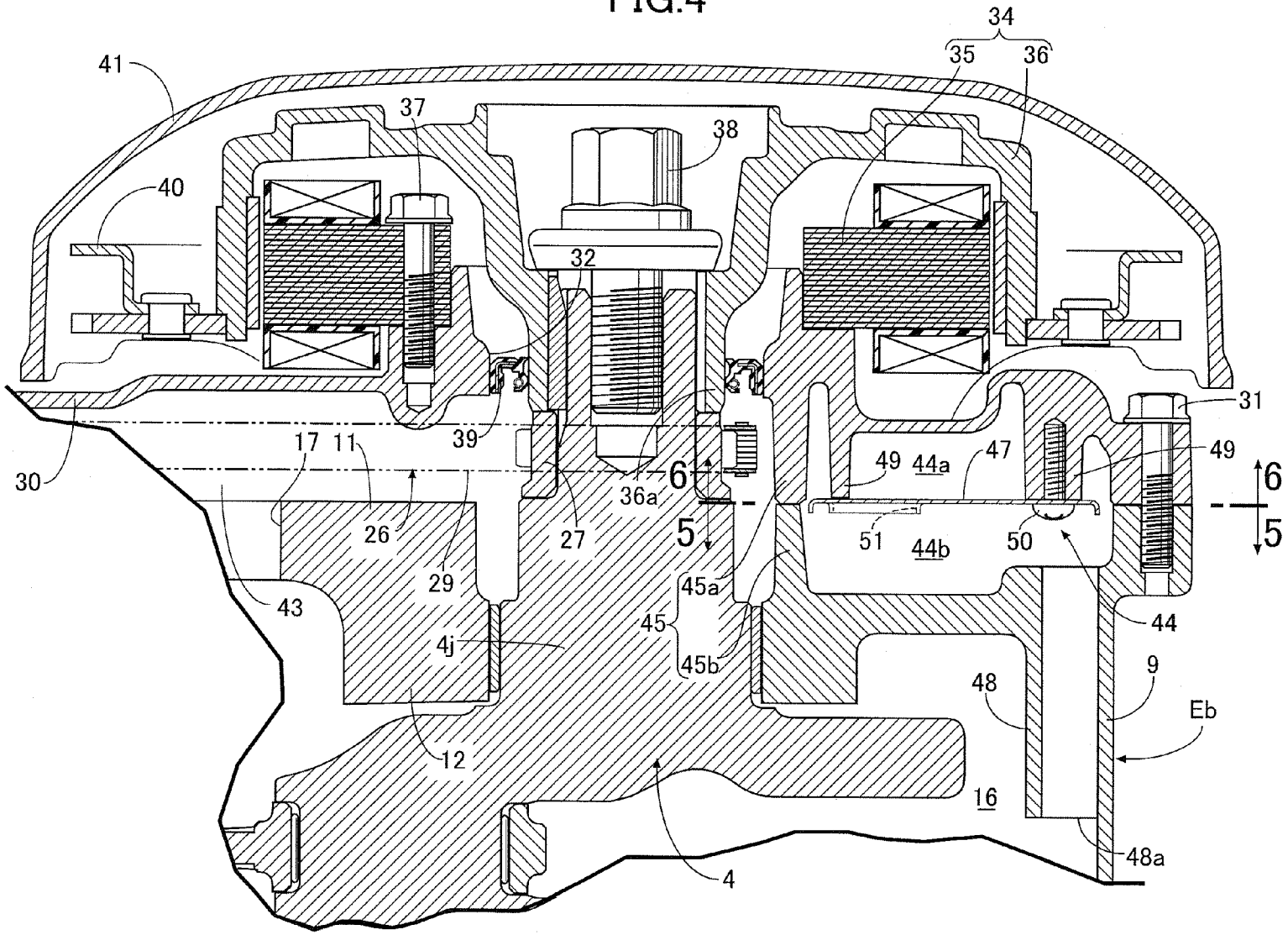
FIG. 4 is an enlarged view of essential portions in FIG. 3.

As shown in FIGS. 2 and 3, the engine E includes the vertically placed crankshaft 4, and a cam shaft 10 placed behind and in parallel with the crankshaft 4.

A plurality of journals 4*j* of the crankshaft 4 are rotatably supported by a plurality of journal support walls 12 formed at joints between a crank case 9 and a cylinder block 11 placed behind the crank case 9. A plurality of vertically arranged cylinder bores 13 are formed in the cylinder block 11, and a piston 15 connected to the crankshaft 4 via a connecting rod 14 is fitted in each cylinder bore 13. Between the crank case 9 and the cylinder block 11, a plurality of crank chambers 16 partitioned by the plurality of journal support walls 12 are defined, and the crank chambers 16 communicate with each other via through holes 17 provided in the journal support walls 12.

The cam shaft 10 is rotatably supported by a cylinder head 18 joined to a rear end surface of the cylinder block 11, and a cam holder 19 joined to the cylinder head 18. The cam shaft 10 is a valve operating cam shaft for opening and closing an intake valve and an exhaust valve corresponding to each cylinder bore 13 due to a rotation of the cam shaft 10.

The crank case 9, the cylinder block 11 and the cylinder head 18 comprise an engine body Eb, a throttle body 20 (see FIG. 2) is provided adjacent to a front surface of the engine body Eb, an intake silencer box 22 connected to an upstream end of the throttle body 20 is provided adjacent to a front right side of the engine body Eb, and an intake manifold 23 that connects a downstream end of the throttle body 20 to an intake port of the cylinder head 18 is provided adjacent to a left side of the engine body Eb. Thus, during operation of the engine E, air flowing into the engine cover 8 through an air inlet 25 in an upper portion of the engine cover 8 flows into the intake silencer box 22 through an intake port 22*a* of the intake silencer box 22, then moves into the throttle body 20, is regulated in flow rate by a throttle valve 21, and then distributed to each cylinder bore 13 through the intake manifold 23.

Upper ends of the crankshaft 4 and the cam shaft 10 protrude upward of the engine body Eb, and the upper ends are connected to each other via a timing transmission device 26. The timing transmission device 26 includes a driven sprocket 27 secured to the upper end portion of the crankshaft 4, a follow sprocket 28 secured to the upper end portion of the cam shaft 10 and having a larger diameter than that of the driven sprocket 27, and a timing chain 29 extending between the sprockets 27 and 28, and transmits rotation of the crankshaft 4 with speed reduced to the half.

To the engine body Eb, a cover member 30 that covers an upper surface of the engine body Eb together with the timing transmission device 26 is joined by a plurality of bolts 31 arranged along a peripheral edge of the cover member 30. The upper end portion of the crankshaft 4 passes through a through hole 32 in the cover member 30 and further protrudes upward, and a generator 34 is mounted between the upper end portion of the crankshaft 4 and the cover member 30. Specifically, an annular stator 35 placed to surround the through hole 32 is secured to an upper surface of the cover member 30 by a bolt 37, and a hub 36*a* of a cylindrical rotor 36 surrounding the stator 35 is spline-fitted to the upper end portion of the crankshaft 4 and secured by a bolt 38. The hub 36*a* is placed so as to pass through the through hole 32, and an oil seal 39 in tight contact with an outer peripheral surface of the hub 36*a* is fitted to the through hole 32. A pulley 40 around which an emergency starter rope is wound is secured to an outer periphery of the rotor 36. The generator 34 is generally covered with a removable generator cover 41.

The cover member 30 defines, between itself and the upper surface of the engine body Eb, a timing transmission chamber 43 housing the timing transmission device 26, and a breather chamber 44 placed on the side opposite from the cam shaft 10 with respect to the crankshaft 4, at a position adjacent to the timing transmission chamber 43 and below the generator 34.

In this case, a bulkhead 45 between the timing transmission chamber 43 and the breather chamber 44 is formed integrally with one or both of the engine body Eb and the cover member 30 as shown in FIGS. 4 to 7. The shown embodiment takes the latter structure. Specifically, the bulkhead 45 is comprised of a lower bulkhead 45*b* integrally protruding on an upper surface of the crank case 9 so as to be as close as possible to a joint surface between the crank case 9 and the cylinder block 11, and an upper bulkhead 45*a* integrally protruding on a lower surface of the cover member 30 so that a lower end of the upper bulkhead 45*a* abuts against an upper end of the lower bulkhead 45*b*.

The breather chamber 44 is partitioned into an upper breather chamber 44*a* and a lower breather chamber 44*b* placed below the upper breather chamber 44*a* by a partition plate 47, and the lower breather chamber 44*b* communicates with a crank chamber 16 via a breather inlet pipe 48 integrally formed with a crank case 9. The breather inlet pipe 48 has an opening end 48*a* into the crank chamber 16, and the opening end 48*a* opened into the crank chamber 16 protrudes inward of the crank chamber 16 from a ceiling wall of the crank chamber 16 so as to prevent droplets of lubricant oil dispersed in the crank chamber 16 from flowing into the breather inlet pipe 48.

The upper breather chamber 44*a* is defined by an endless surrounding wall 49 integrally protruding on a lower surface of the cover member 30 so as to be as close as possible to an inner peripheral surface of the breather chamber 44, and the partition plate 47 joined to a lower end surface of the surrounding wall 49 by a plurality of screws 50. The partition plate 47 has a communication hole 51 that provides communication between the upper and lower breather chambers 44*a* and 44*b* on the side opposite from the breather inlet pipe 48. The upper breather chamber 44*a* communicates with a breather outlet pipe 52 integrally formed with the cover member 30 on the side opposite from the communication hole 51. To an outer end of the breather outlet pipe 52 protruding from an outer side surface of the cover member 30, a connecting pipe 53 integrally formed with a side wall of the intake silencer box 22 and communicating with the inside of the intake silencer box 22 is fitted via a seal member 54.

Figure 5:
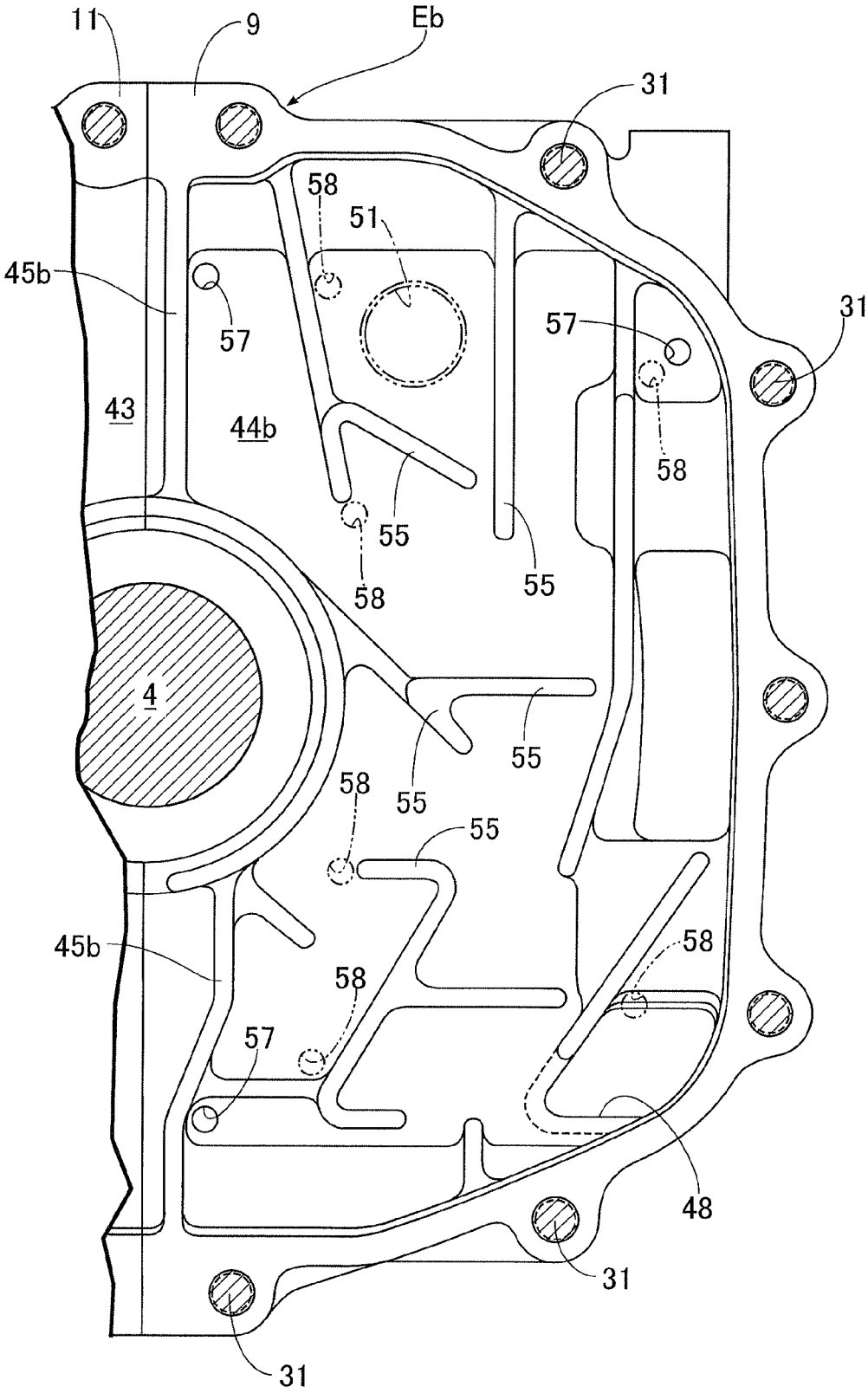
FIG. 5 is a sectional view taken along the line 5-5 in FIG. 4.
Figure 6:
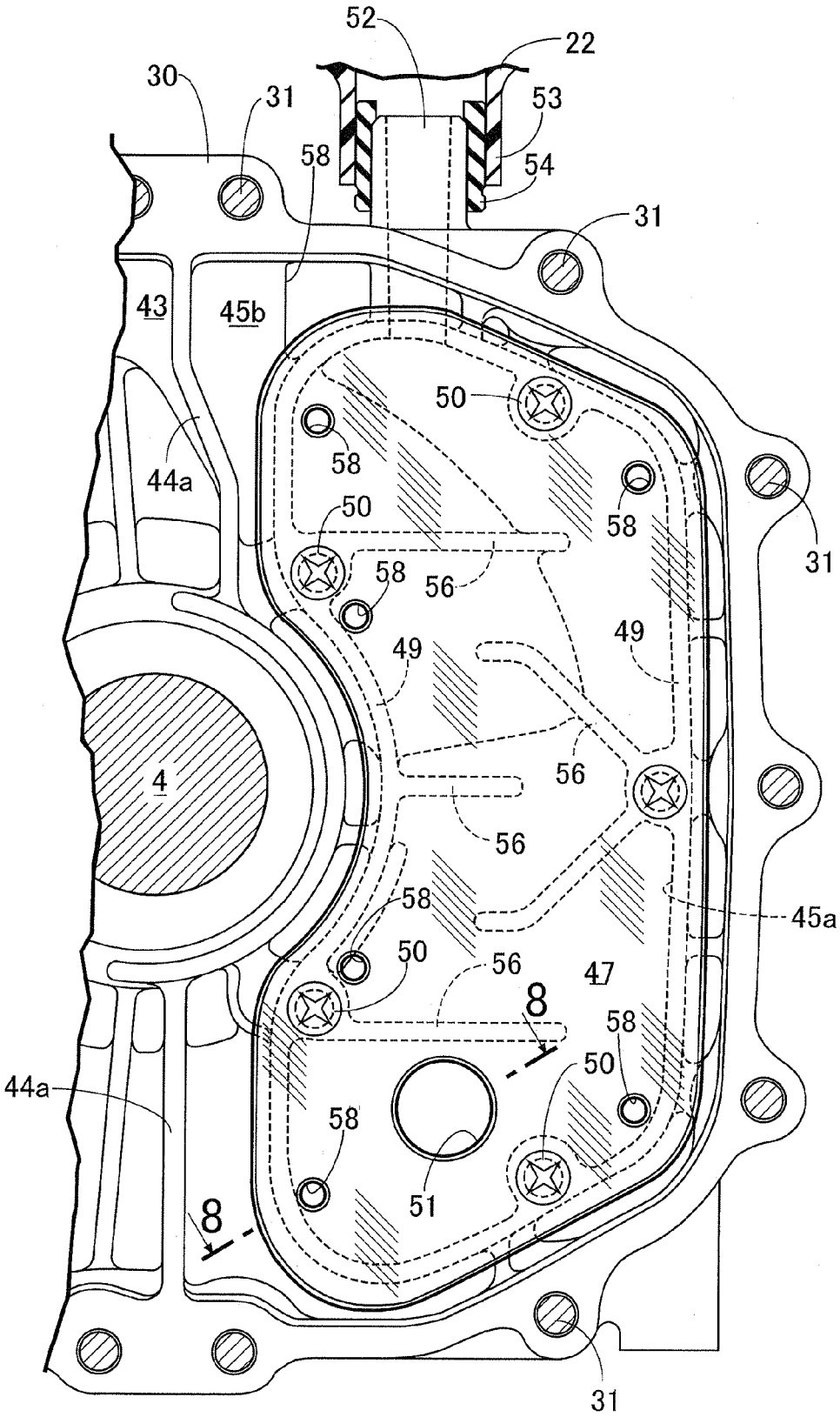
FIG. 6 is a sectional view taken along the line 6-6 in FIG. 4.
Figure 7:
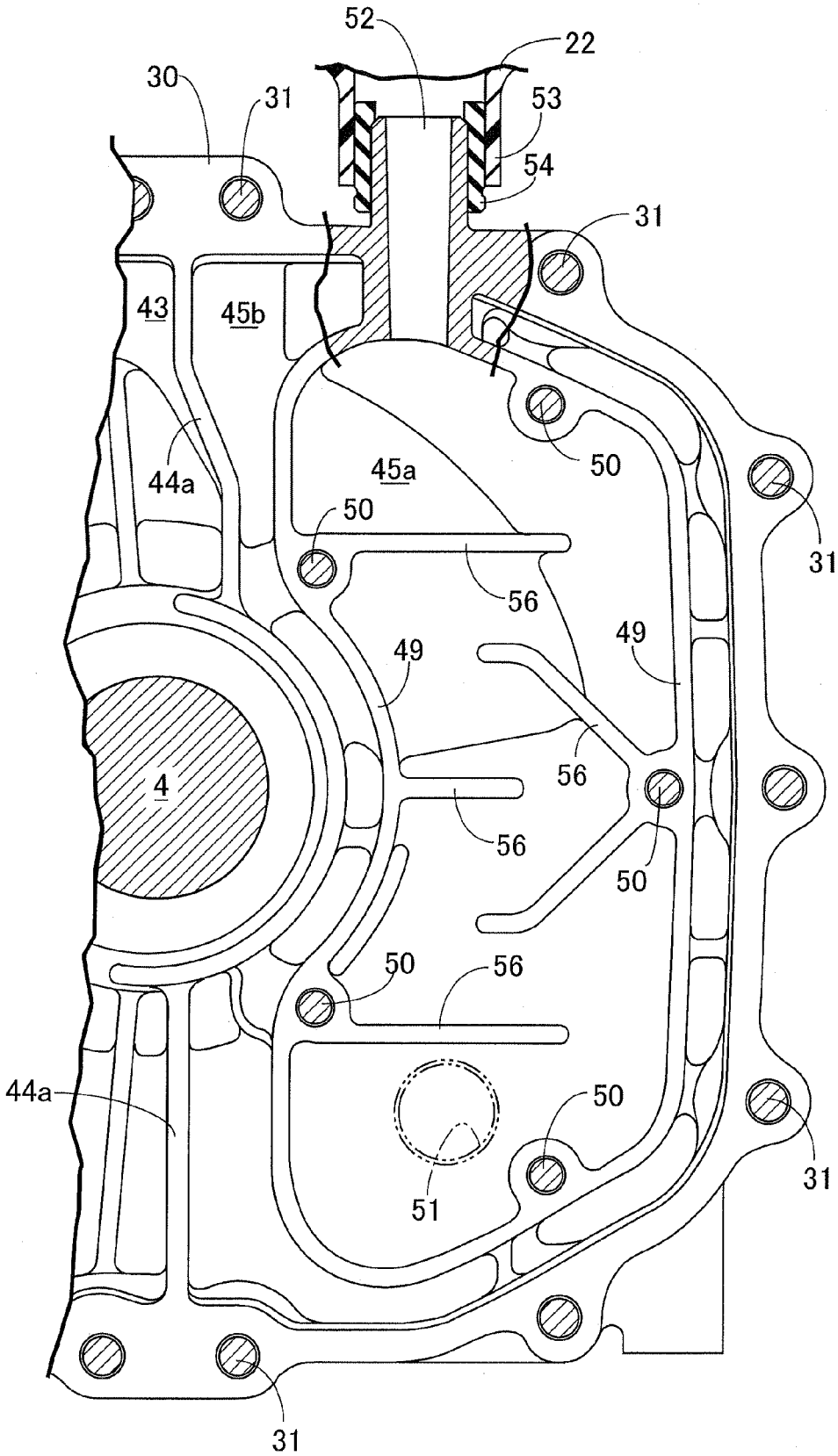
FIG. 7 is a view corresponding to FIG. 6 with a partition plate being removed.

As shown in FIG. 5, in the lower breather chamber 44*b*, a plurality of lower labyrinth walls 55 are arranged to form channels extending from the breather inlet pipe 48 to the communication hole 51 in a labyrinth manner, and the lower labyrinth walls 55 are integrally formed with the crank case 9. As shown in FIGS. 6 and 7, also in the upper breather chamber 44*a*, a plurality of upper labyrinth walls 56 are arranged to form channels extending from the communication hole 51 to the breather outlet pipe 52 in a labyrinth manner, and the upper labyrinth walls 56 are integrally formed with the cover member 30.

Figure 8:
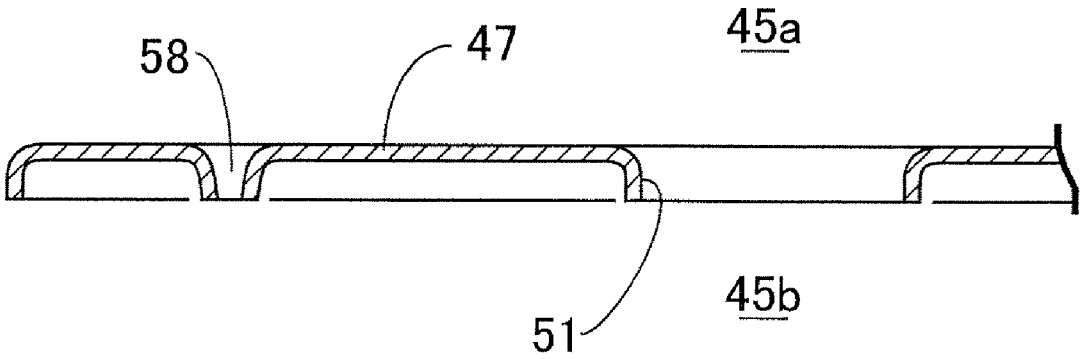
FIG. 8 is a sectional view taken along the line 8-8 in FIG. 6.

Returning to FIG. 5, lower oil return holes 57 that provide communication between the lower breather chamber 44*b* and the crank chamber 16 immediately below the lower breather chamber 44*b* and have a much smaller diameter than that of the communication hole 51 are provided at a plurality of corners on a bottom wall of the lower breather chamber 44*b*. Also as shown in FIGS. 6 and 8, upper oil return holes 58 that provide communication between the upper breather chamber 44*a* and the lower breather chamber 44*b* and similarly have a small diameter are provided at a plurality of corners on the partition plate 47. The upper oil return hole 58 is formed into a funnel shape so as to facilitate oil stored on the upper surface of the partition plate 47 flowing down to the lower breather chamber 44*b*. The lower oil return hole 57 and the upper oil return hole 58 are placed in positions offset from each other on plan view (see FIG. 5) so that droplets of oil in the crank chamber 16 do not reach the upper oil return hole 58 even if swiftly passing through the lower oil return hole 57.

Next, an operation of the first embodiment will be described.

When pressure in the crank chamber 16 changes with reciprocating motion of the piston 15 during operation of the engine E, breathing operations occur between the crank chamber 16 and the intake silencer box 22 upstream of the throttle body 20 through the breather inlet pipe 48, the lower breather chamber 44*b*, the communication hole 51, the upper breather chamber 44*a* and the breather outlet pipe 52. During these operations, a blow-by gas generated in the crank chamber 16 is exhausted to the intake silencer box 22 together with the breathing gas, and taken in by the engine E together with intake air flowing in the intake silencer box 22. At the time of air intake in the crank chamber 16, fresh air in the intake silencer box 22 flows reversely through the above described path into the crank chamber 16.

In the crank chamber 16, a large number of droplets of lubricant oil are dispersed by operation of the crankshaft 4, the connecting rod 14, and the piston 15, form oil mist and are mixed into air or a blow-by gas in the crank chamber 16. Every time the breathing gas of the crank chamber 16 including the oil mist is exhausted from the breather inlet pipe 48 to the lower breather chamber 44*b*, and from the lower breather chamber 44*b* through the communication hole 51 to the upper breather chamber 44*a*, pressure reduction caused by expansion of the breathing gas allows oil mist to be liquefied and separated from the breathing gas. In the lower breather chamber 44*b*, the breathing gas collides with the plurality of lower labyrinth walls 55 and is truned its movement path when flowing from the breather inlet pipe 48 toward the communication hole 51. Thus, the oil mist adheres to the lower labyrinth walls 55 and is liquefied and separated from the breathing gas. Similarly, in the upper breather chamber 44*a*, the breathing gas collides with the plurality of the upper labyrinth walls 56 and is turned its movement path when flowing from the communication hole 51 toward the breather outlet pipe 52. Thus, the oil mist adheres to the upper labyrinth walls 56 and is liquefied and separated from the breathing gas.

In this manner, the oil separated from the breathing gas in the upper breather chamber 44*a* falls through the upper oil return hole 58 in the partition plate 47 to the lower breather chamber 44*b* side, and the oil separated from the breathing gas in the lower breather chamber 44*b* falls through the lower oil return hole 57 to the crank chamber 16 together with the oil having fallen through the upper oil return hole 58.

In this manner, the oil mist contained in the breathing gas in the crank chamber 16 can be efficiently separated from the breathing gas and returned to the crank chamber 16 by a two-step pressure reducing action and a long labyrinth action, thereby effectively preventing unnecessary discharge of the lubricant oil.

Further, the breather chamber 44, dedicated for gas-liquid separation, having large capacity, and comprised of the upper and lower breather chambers 44*a* and 44*b* is placed in dead space between the crank case 9 and the generator 34 on the side opposite from the cam shaft 10 with respect to the crankshaft 4, thereby preventing an increase of the entire size of the engine E due to the breather chamber 44.

The timing transmission chamber 43 and the breather chamber 44 are defined between the engine body Eb and the cover member 30 joined to the upper surface of the engine body Eb by the bolts, and the bulkhead 45 between the timing transmission chamber 43 and the breather chamber 44 is integrally formed with one or both of the crank case 9 and the cover member 30. Thus, by simply joining the cover member 30 to the upper surface of the engine body Eb, the timing transmission chamber 43 and the breather chamber 44 can be easily formed between the cover member 30 and the upper surface of the engine body Eb, thereby simplifying a structure and increasing assembling properties.

Further, the rotor 36 of the generator 34 is secured to the outer end portion of the crankshaft 4 passing through the through hole 32 provided in the cover member 30, and the stator 35 that cooperates with the rotor 36 is mounted to the upper surface of the cover member 30. Thus, the cover member 30 has a broad upper surface wall extending from the timing transmission chamber 43 to the breather chamber 44, and hence the stator 35 can be easily mounted using the upper surface wall.

Figure 9:
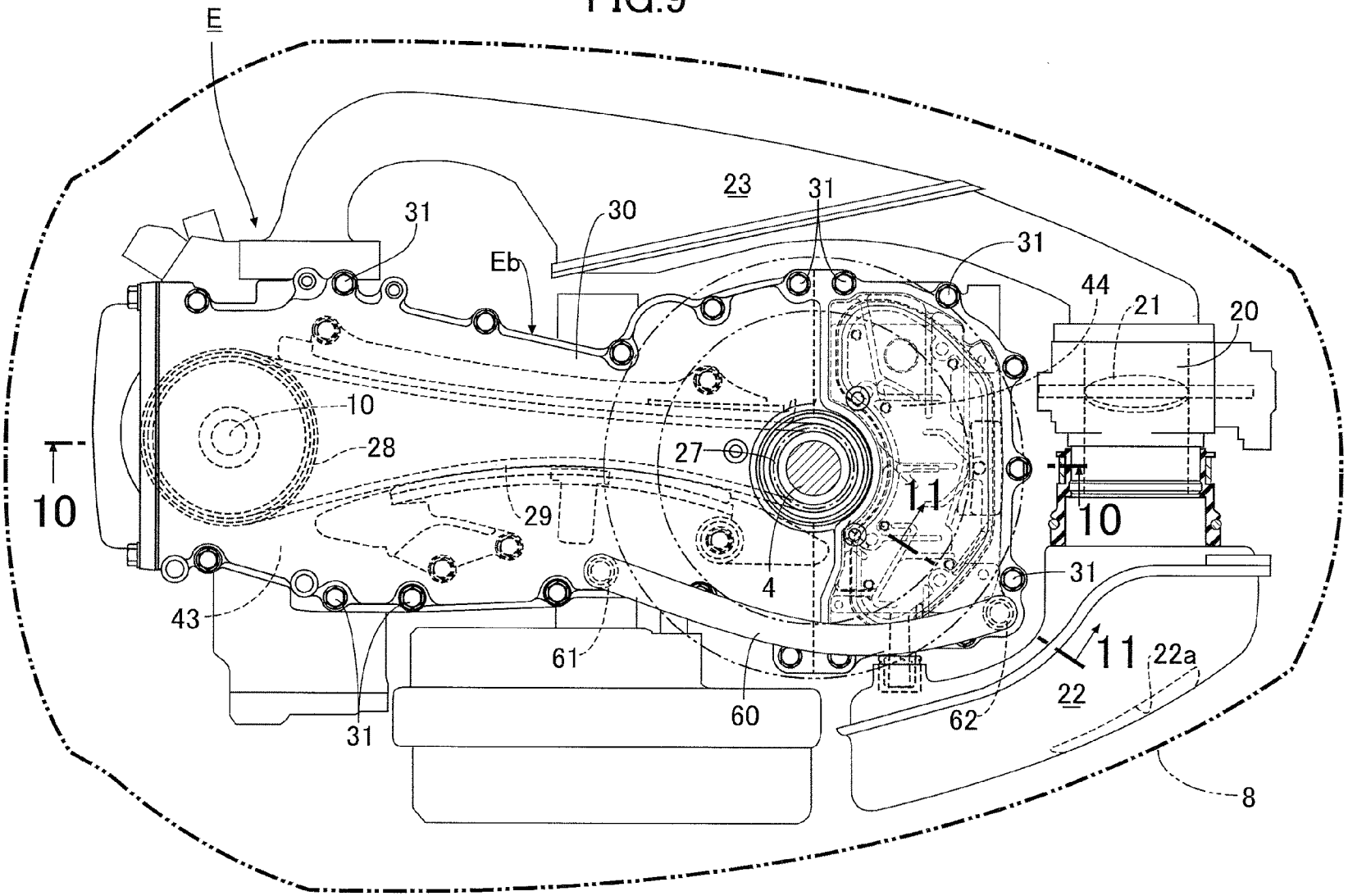
FIG. 9 is a view of a second embodiment of the present invention corresponding to FIG. 2.
Figure 10:
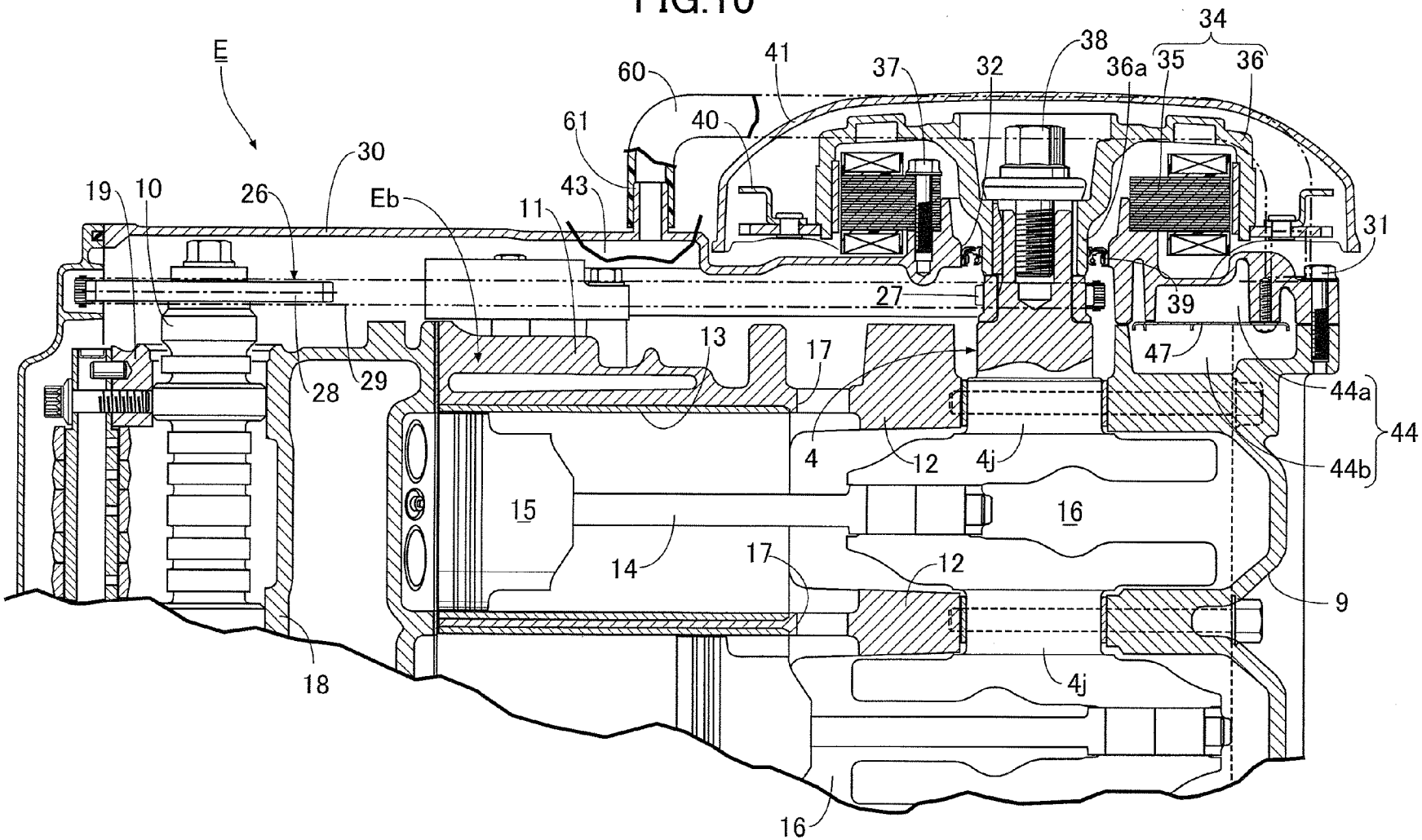
FIG. 10 is a sectional view taken along the line 10-10 in FIG. 9.
Figure 11:
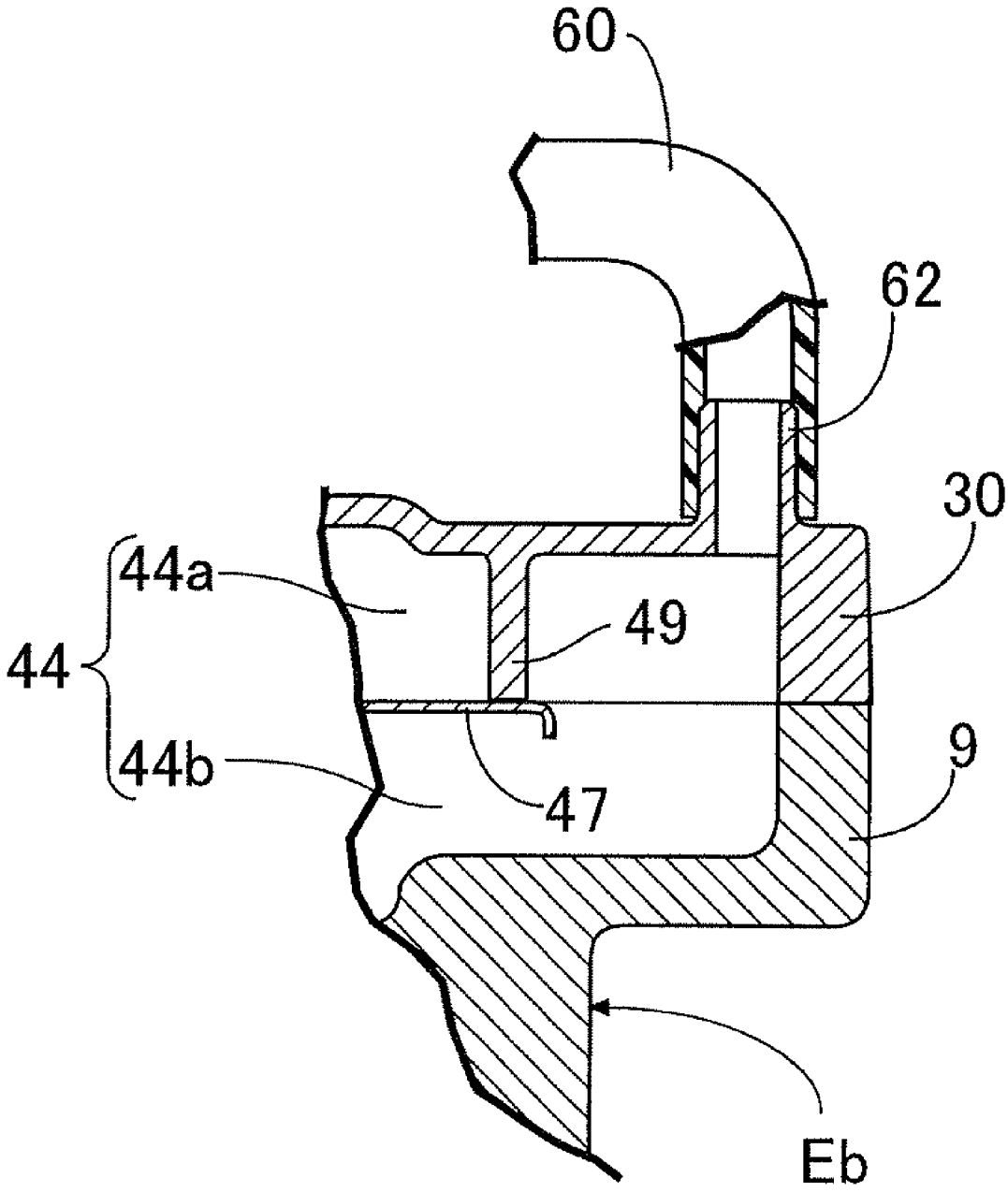
FIG. 11 is a sectional view taken along the line 11-11 in FIG. 9.

Next, the second embodiment of the present invention shown in FIGS. 9 to 11 will be described.

In the second embodiment, communication is provided between a crank chamber 16 and a lower breather chamber 44*b* via a timing transmission chamber 43, and the timing transmission chamber 43 also serves as a pre-breather chamber. Specifically, a first connecting pipe 61 opening into the timing transmission chamber 43 on the outside of a travel path of a timing chain 29, and a second connecting pipe 62 opening into the lower breather chamber 44*b* are integrally formed with a cover member 30, and the connecting pipes 61 and 62 are connected to each other via a flexible communication tube 60. Thus, in the second embodiment, unlike in the first embodiment, a breather inlet pipe 48 that provides direct communication between the crank chamber 16 and the lower breather chamber 44*b* is not provided. Other configurations are the same as in the first embodiment, thus in FIGS. 9 to 11, components corresponding to those in the first embodiment will be denoted by the same reference numerals, and overlapping descriptions will be omitted.

In the second embodiment, when pressure in the crank chamber 16 changes with reciprocating motion of a piston 15 during operation of an engine E, breathing operations occur between the crank chamber 16 and an intake silencer box 22 through a through hole 17 in an uppermost journal support wall 12, the timing transmission chamber 43, the communication tube 60, the lower breather chamber 44*b*, a communication hole 51, an upper breather chamber 44*a* and a breather outlet pipe 52. The breathing gas in the crank chamber 16 is first exhausted through the through hole 17 to the timing transmission chamber 43 having large capacity and reduced in pressure to allow oil mist to be liquefied and separated. Thus, the timing transmission chamber 43 serves as a pre-breather chamber and cooperates with the upper and lower breather chambers 44*a* and 44*b* dedicated for gas-liquid separation, thereby allowing oil to be more efficiently separated from the breathing gas in the crank chamber 16.

In particular, the opening of the first connecting pipe 61 into the timing transmission chamber 43 is placed on the outside of the travel path of the timing chain 29, thereby preventing as much as possible droplets of lubricant oil dispersed from the timing chain 29 from entering the communication tube 60 side.

The communication tube 60 has flexibility, and thus can be freely placed without choosing a position of the breather chamber 44, thereby further increasing placement flexibility of the breather chamber 44. Further, communication between the timing transmission chamber 43 and the breather chamber 44 can be provided easily and inexpensively. Further, the oil mist is cooled by the communication tube 60 when passing through the communication tube 60, returns to the timing transmission chamber 43 or moves to the breather chamber 44 in a liquefied state, and is not discharged to the outside, thereby facilitating gas-liquid separation.

The present invention is not limited to the above described embodiments, and various changes in design may be made without departing from the gist of the invention. For example, the breather outlet pipe 52 may be connected to an intake system of the engine other than the intake silencer box 22, or made open to the atmosphere.

What is claimed is:

1. A vertical type engine comprising:

an engine body having a crank chamber and a cylinder bore;

a timing transmission chamber provided above the engine body and housing a timing transmission device that connects between a crankshaft and a cam shaft which are vertically placed, respectively;

a generator driven by the crankshaft positioned above the timing transmission device;

a breather chamber communicating with the crank chamber and an outside provided between the generator and the crank chamber, wherein the breather chamber is positioned below the generator on an opposite side of the crankshaft from the cam shaft; and a cover member joined to the engine body and covering an upper surface of the engine body, wherein the timing transmission chamber and the breather chamber are defined by the upper surface of the engine body and the cover member.

2. The vertical type engine according to claim 1, wherein a bulkhead between the timing transmission chamber and the breather chamber is integrally formed with one or both of the engine body and the cover member.

3. The vertical type engine according to claim 2, wherein a rotor of the generator is mounted to an outer end of the crankshaft passing through a through hole provided in the cover member, and a stator of the generator is mounted to the cover member.

4. The vertical type engine according to any one of claims 1 to 3, wherein communication is provided between the breather chamber and the crank chamber via a breather inlet pipe protruding downward from an upper inner surface of the crank chamber.

5. The vertical type engine according to any one of claims 1 to 3, wherein communication is provided between the crank chamber and the breather chamber via the timing transmission chamber.

6. The vertical type engine according to any one of claims 1 to 3, wherein the breather chamber is comprised of an upper breather chamber and a lower breather chamber which are vertically arranged one on another with a partition plate therebetween, the partition plate has a communication hole that provides communication between the upper breather chamber and the lower breather chamber, and one of the upper breather chamber and the lower breather chamber communicates with the crank chamber and the other communicates with the outside.

* * * * *